US010178882B2

(12) United States Patent
Yue

(10) Patent No.: US 10,178,882 B2
(45) Date of Patent: Jan. 15, 2019

(54) ELECTRIC GARMENT

(71) Applicant: Steven Yue, Taipei (TW)

(72) Inventor: Steven Yue, Taipei (TW)

( * ) Notice: Subject to any disclaimer, the term of this patent is extended or adjusted under 35 U.S.C. 154(b) by 255 days.

(21) Appl. No.: 15/132,834

(22) Filed: Apr. 19, 2016

(65) Prior Publication Data

US 2017/0150760 A1 Jun. 1, 2017

(30) Foreign Application Priority Data

Nov. 26, 2015 (TW) ..... 104139322 A

(51) Int. Cl.

| | |
|---|---|
| ***H05B 1/02*** | (2006.01) |
| ***A41D 1/00*** | (2018.01) |
| ***A41D 13/005*** | (2006.01) |
| ***A41B 11/00*** | (2006.01) |
| ***A41D 1/06*** | (2006.01) |
| ***A41D 19/00*** | (2006.01) |

(Continued)

(52) U.S. Cl.

CPC ..... *A41D 1/005* (2013.01); *A41B 11/00* (2013.01); *A41D 1/06* (2013.01); *A41D 13/0051* (2013.01); *A41D 19/0041* (2013.01); *H05B 1/0272* (2013.01); *H05B 3/0014* (2013.01); *H05B 3/342* (2013.01)

(58) Field of Classification Search

CPC ..... A41D 1/005; A41D 1/06; A41D 13/0051; A41D 19/0041; A41B 11/00; H05B 1/0275; H05B 3/0014; H05B 3/345; H05B 3/347; H05B 2203/005

USPC ..... 219/211, 212, 494, 497, 483, 496

See application file for complete search history.

(56) References Cited

U.S. PATENT DOCUMENTS 5,105,067 A * 4/1992 Brekkestran ..... G05D 23/2401 2/69
5,893,991 A * 4/1999 Newell ..... A41D 13/0051 219/211

(Continued)

FOREIGN PATENT DOCUMENTS

CA 2811111 C 1/2014
EP 2 314 744 A2 4/2011

(Continued)

OTHER PUBLICATIONS

Search Report, issued in counterpart European Application No. 16167821.4, dated Mar. 29, 2017 (9 pages).

(Continued)

*Primary Examiner* — Mark Paschall
(74) *Attorney, Agent, or Firm* — Hamre, Schumann, Mueller & Larson, P.C.

(57) ABSTRACT

An electric garment includes an article of clothing, a first electrical device attached to the article of clothing, and a retractable connector assembly. The retractable connector assembly includes an electric cord electrically connected to the first electrical device, a first connector, and a retractable unit that includes an elastic member connected to the electric cord. The first connector is movable relative to the article of clothing between a concealed position and an exposed position. When the first connector is moved from the concealed position to the exposed position, the elastic member is deformed for generating a restoring force to move the first connector back to the concealed position.

18 Claims, 8 Drawing Sheets

(51) Int. Cl.
*H05B 3/00* (2006.01)
*H05B 3/34* (2006.01)

(56) References Cited

U.S. PATENT DOCUMENTS

| | | | | |
|---|---|---|---|---|
| 6,653,607 | B2 * | 11/2003 | Ellis | A61F 7/007 219/212 |
| 7,566,846 | B1 * | 7/2009 | Sorensen | H05B 1/02 2/905 |
| 9,242,093 | B1 * | 1/2016 | Sherman | A61N 1/36032 |
| 9,693,891 | B2 * | 7/2017 | MacIntyre-Ellis | A61F 7/08 |
| 9,764,100 | B2 * | 9/2017 | Faries, Jr. | A61M 5/44 |
| 2003/0074712 | A1 * | 4/2003 | Liao | A41D 1/005 2/93 |
| 2006/0076339 | A1 * | 4/2006 | Mohn | H05B 3/342 219/217 |
| 2009/0289046 | A1 * | 11/2009 | Richmond | A41D 13/0051 219/211 |
| 2014/0191706 | A1 | 7/2014 | Maese | |

FOREIGN PATENT DOCUMENTS

| | | | |
|---|---|---|---|
| EP | 2 687 113 | A1 | 1/2014 |
| TW | I458443 | B | 11/2014 |

OTHER PUBLICATIONS

Search Report issued in Canadian counterpart application No. 2927476 by the CIPO dated Oct. 30, 2017, 4 pages.
Search Report issued in counterpart Taiwanese Application No. 104139322 dated May 10, 2016 and corresponding English translation.

* cited by examiner

ELECTRIC GARMENT

CROSS-REFERENCE TO RELATED APPLICATION

This application claims priority of Taiwanese Patent Application No. 104139322, filed on Nov. 26, 2015.

FIELD

The disclosure relates to an electric garment, and more particularly to an electric garment having a retractable electrical connector assembly.

BACKGROUND

A conventional electric-heating garment is in the form of an upper garment, and includes an article of clothing, at least one first electric-heating element, a power supply, a pair of gloves, and two second electric-heating elements.

The at least one first electric-heating element is attached to the article of clothing. The power supply is operable to supply electric power to the at least one first electric-heating element for warming up the article of clothing. The second electric-heating elements are respectively attached to the gloves. The power supply is provided with two male connectors, and each of the second electric-heating elements is provided with a female connector that is operable to be connected to a respective one of the male connectors so as to permit electricity to be transmitted from the power supply to the second electric-heating elements for warming up the gloves.

Each of the male connectors is connected to the power supply via an electric cord. When in use, the electric cords are extended and exposed from the article of clothing for connection between the male and female connectors. When the male and female connectors are disconnected after use, the electric cords have to be manually wrapped and placed into the article of clothing for a neat appearance and for preventing each of the electric cords from tangling. However, such wrapping process is time-consuming and may be troublesome for a wearer.

SUMMARY

Therefore, an object of the disclosure is to provide an electric garment that can alleviate at least one of the drawbacks of the prior art.

According to the disclosure, the electric garment is adapted to be worn by a wearer. The electric garment includes an article of clothing, a first electrical device, and a retractable connector assembly.

The article of clothing includes a clothing main body and two limb parts. At least one of the limb parts is formed with a slit.

The first electrical device is attached to the article of clothing.

The retractable connector assembly includes an electric cord, a first connector, and a retractable unit. The electric cord is electrically connected to the first electrical device, and is at least partially received in the slit. The first connector is electrically connected to the electric cord, and is movable relative to the article of clothing between a concealed position, where the first connector is concealed within the at least one of the limb parts and located outside of the slit, and an exposed position, where the first connector is exposed from the at least one of the limb parts. The retractable unit includes an elastic member connected to the electric cord.

When the first connector is moved from the concealed position to the exposed position, the elastic member is deformed for generating a restoring force to move the first connector back to the concealed position.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
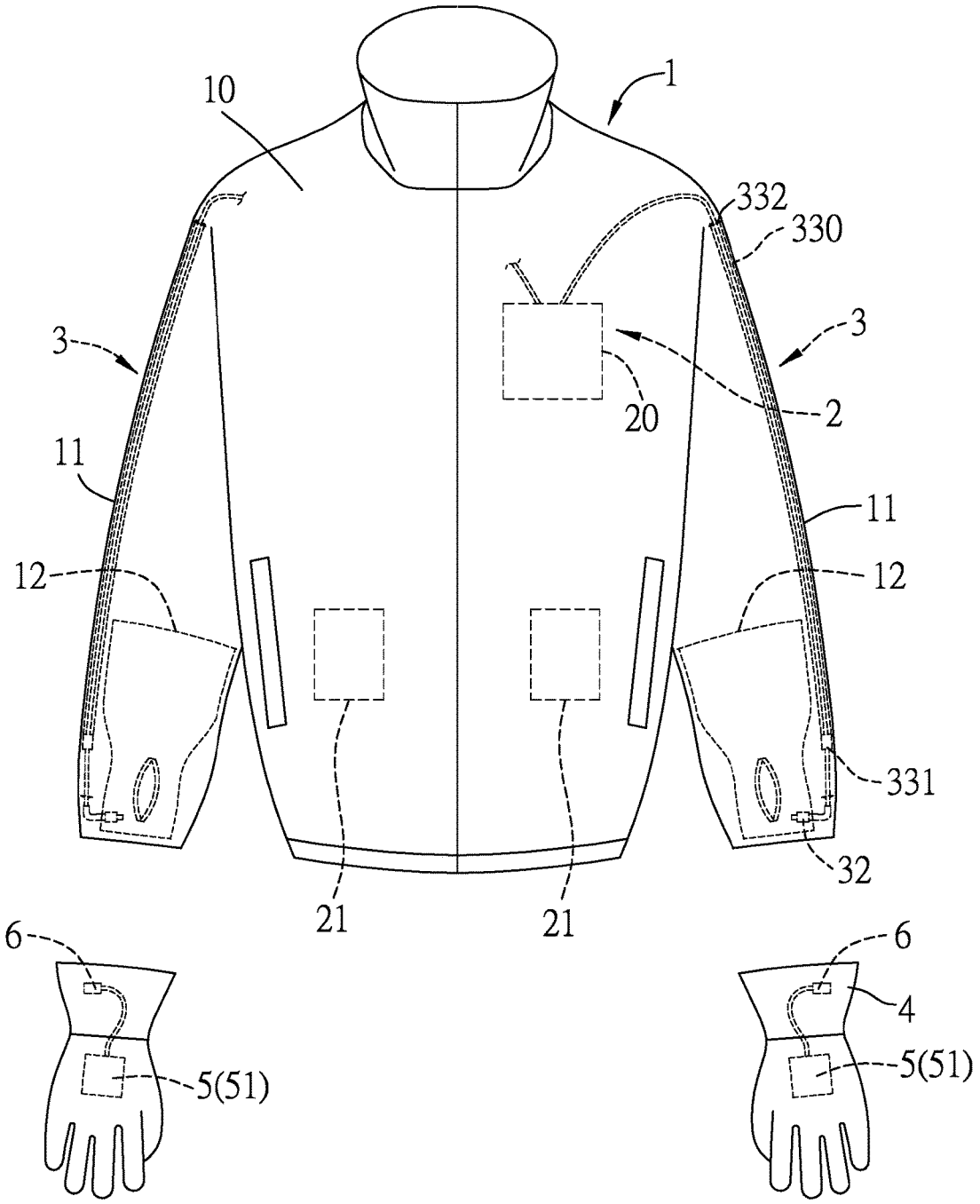
FIG. 1 is a schematic front view illustrating a first embodiment of an electric garment according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
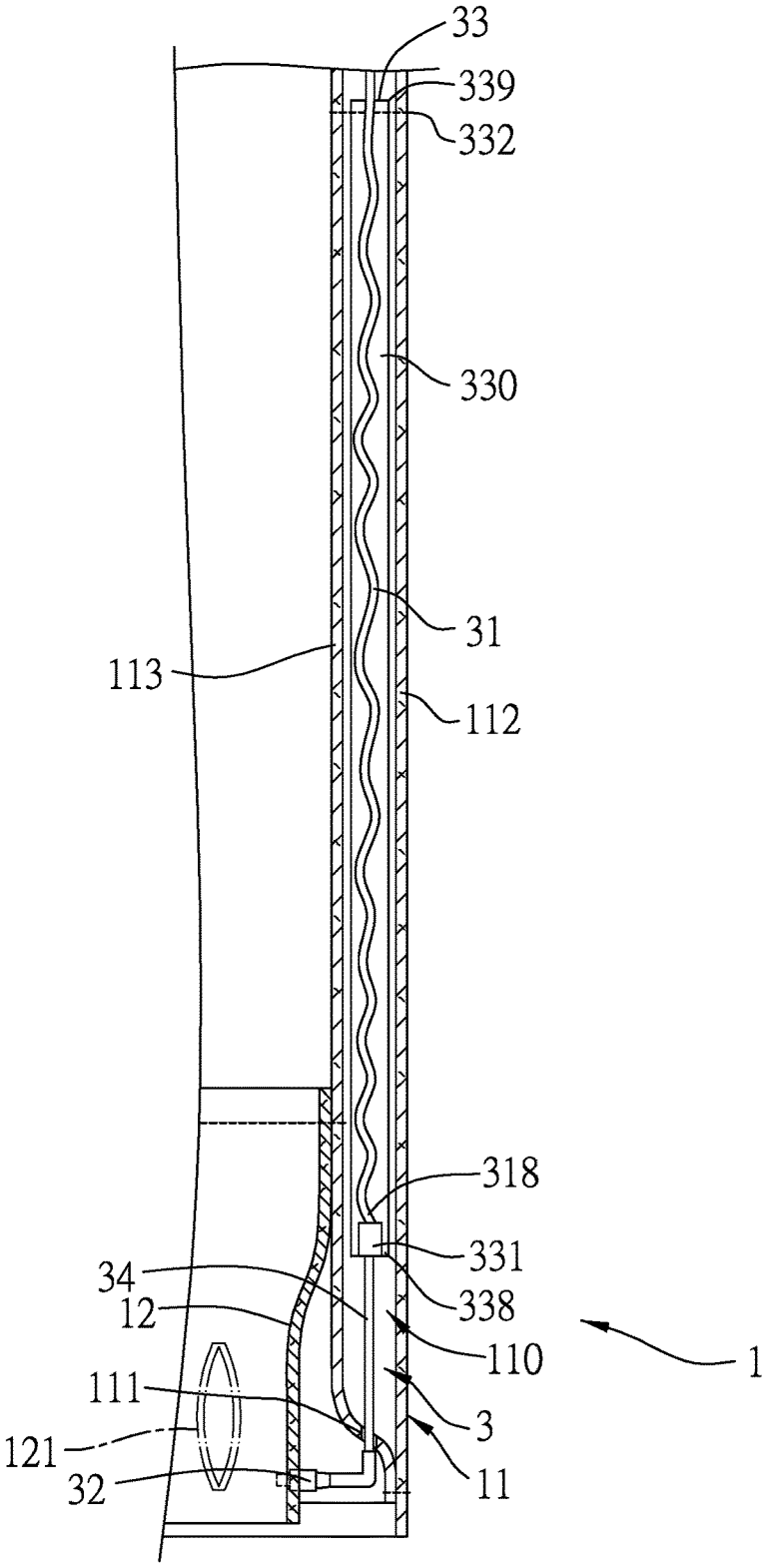
FIG. 2 is an enlarged fragmentary partly sectional view of the first embodiment, illustrating a first connector of the electric garment at a concealed position.

Referring to FIGS. 1 to 2, the first embodiment of an electric garment according to the present disclosure is adapted to be worn by a wearer (not shown). The electric garment includes an article of clothing 1, a first electrical device 2, and a pair of retractable connector assemblies 3, a pair of wearable accessories 4, a pair of second electrical devices 5, and a pair of second connectors 6.

The article of clothing 1 includes a clothing main body 10 and two limb parts 11 extending from the clothing main body 10. Each of the limb parts 11 is formed with a slit 110. In this embodiment, the article of clothing 1 is an upper garment, each of the limb parts 11 is a sleeve, and the wearable accessories 4 are a pair of gloves that can be respectively worn on two hands of the wearer. Each of the limb parts 11 includes an inner lining layer 113 and an outer cloth layer 112 that surrounds the inner lining layer 113 and that cooperates with the inner lining layer 113 to define the slit 110 therebetween. Each of the slits 110 has an exit end 111 adjacent to a cuff of a respective one of the limb parts 11.

The article of clothing 1 further includes two glove-resembling portions 12, each of which is connected to the inner lining layer 113 of a respective one of the limb parts 11, is disposed at a position oorresponding to a cuff of a corresponding one of the limb parts 11, and is formed with a through hole 121 adapted for a corresponding one of two thumbs of the wearer to extend therethrough.

The first electrical device 2 is attached to the article of clothing 1, and includes a power supply 20 and two electric-heating elements 21 electrically connected to the power supply 20.

Each of the retractable connector assemblies 3 includes an electric cord 31, an extension cord 34, a first connector 32, and a retractable unit 33. Since the structures of the retractable connector assemblies 3 are identical, only one of the retractable connector assemblies 3 is described below for the sake of brevity.

The electric cord 31 is electrically connected to the first electrical device 2, and is partially received in the slit 110 of a corresponding one of the limb parts 11. The electric cord 31 has one end that is electrically connected to the extension cord 34, and the other end that is electrically connected to the power supply 20.

The extension cord 34 electrically interconnects the electric cord 31 and the first connector 32. In this embodiment, the electric cord 31 and the extension cord 34 are integrally formed.

Figure 3:
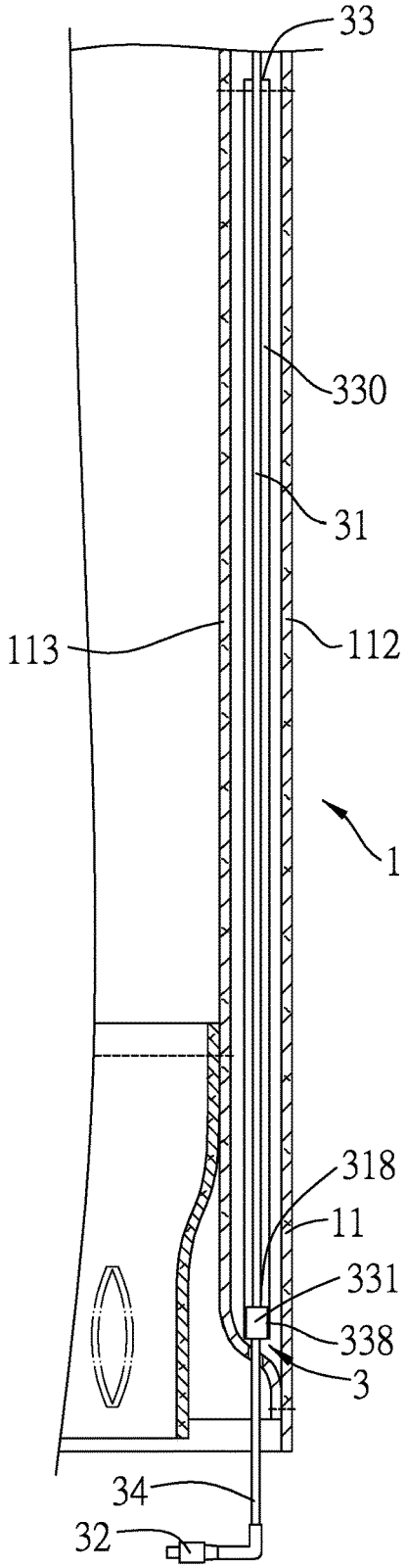
FIG. 3 is a view similar to FIG. 2, but illustrating the first connector at an exposed position.

The first connector 32 is movable relative to the article of clothing 1 between a concealed position (see FIG. 2), where the first connector 32 is concealed within the corresponding limb part 11 and located outside of the slit 110 of the corresponding limb part 11, and an exposed position (see FIG. 3), where the first connector 32 is exposed from the corresponding limb part 11. The first connector 32 is shaped so as to prevent the first connector 32 from entering into the slit 110 of the corresponding limb part 11 via the exit end 111 of the corresponding limb part 11. In this embodiment, the first connector 32 is L-shaped.

The retractable unit 33 includes an elastic member 330 and a fixing member 331. The elastic member 330 has a first end 338 that is proximate to the first connector 32, and a second end 339 that is distal from the first connector 32, and that is fixedly connected to the electric cord 31 in the corresponding slit 110 via a stitch line 332 at a position that corresponds to a shoulder of the wearer. In this embodiment, the elastic member 330 is configured as an elastic strap. The fixing member 331 fixes the first end 338 of the elastic member 330 to the end of the electric cord 31 which is proximate to the first connector 32.

Each of the second electrical devices 5 is attached to a respective one of the gloves. In this embodiment, each of the second electrical devices 5 includes an electric-heating element 51. In certain embodiments, the electric garment may be used to measure physiological parameters of the wearer, e.g., heartbeat. To be more specific, each of the second electrical devices 5 includes a sensor (not shown) for taking the physiological measurements, and the first electrical device 2 is a processor for processing the physiological measurements.

Each of the second connectors 6 is electrically connected to a respective one of the second electrical devices 5, and is operable to be connected to the corresponding first connector 32 so as to permit electricity to be transmitted from the first electrical device 2 to the respective one of the second electrical devices 5.

For each retractable connector assembly 3, since the second end 339 of the elastic member 330 is fixed to the corresponding limb part 11, i.e., the sleeve, and since the first end 338 of the elastic member 330 is fixed to the end of the electric cord 31 by virtue of the fixing member 331, but is not fixed to the sleeve, the extension cord 34 and the fixing member 331 are moved together with the first connector 32 when the first connector 32 is manually pulled out and moved from the concealed position to the exposed position. At this time, the elastic member 330 is stretched and deformed for generating a restoring force to move the first connector 32 back to the concealed position. When the first connector 32 is at the exposed position, the first connector 32 can be connected to the corresponding one of the second connectors 6 so as to permit electricity to be transmitted from the power supply 20 to a corresponding one of the second electrical devices 5 for warming up the corresponding wearable accessory 4. When the first and second connectors 32, 6 are disconnected, and the first connector 32 is released by the wearer, the first connector 32 retracts back to the concealed position via the restoring force of the elastic member 330.

It is worth mentioning that the glove-resembling portions 12 of the article of clothing 1 provide similar function as gloves for reducing heat loss around the wrists of the wearer. If the wearer needs to wear an additional layer of clothing, e.g., a raincoat or a windbreaker, outside of the article of clothing 1 of the electric garment, the wearer may extend his or her thumbs respectively through the through holes 121 of the glove-resembling portions 12 of the article of clothing 1 so as to prevent the cuffs of the article of clothing 1 from moving toward the shoulder of the wearer when wearing the additional layer of clothing. Moreover, the glove-resembling portions 12 of the article of clothing 1 permit the first connector 32 of each of the retractable connector assemblies 3 to be easily reached by the wearer.

Figure 4:
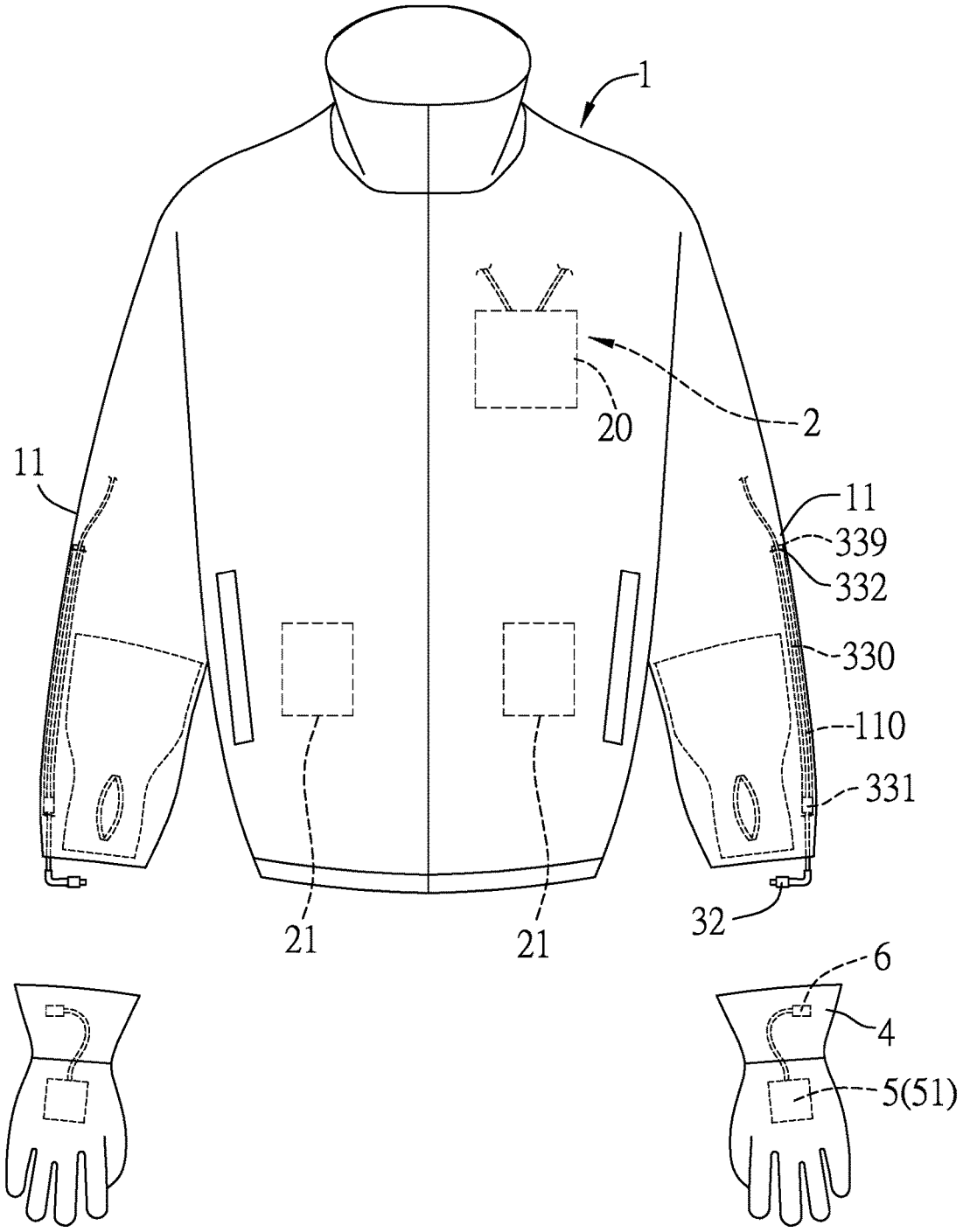
FIG. 4 is a schematic front view illustrating a second embodiment of the electric garment according to the disclosure.

Referring to FIG. 4, a second embodiment of the electric garment according to the disclosure is similar to the first embodiment. The difference between the first and second embodiments resides in that, in terms of each retractable connector assembly 3, the second end 339 of the elastic member 330 is fixed in the slit 110 at a position that corresponds to an elbow of the wearer.

Figure 5:
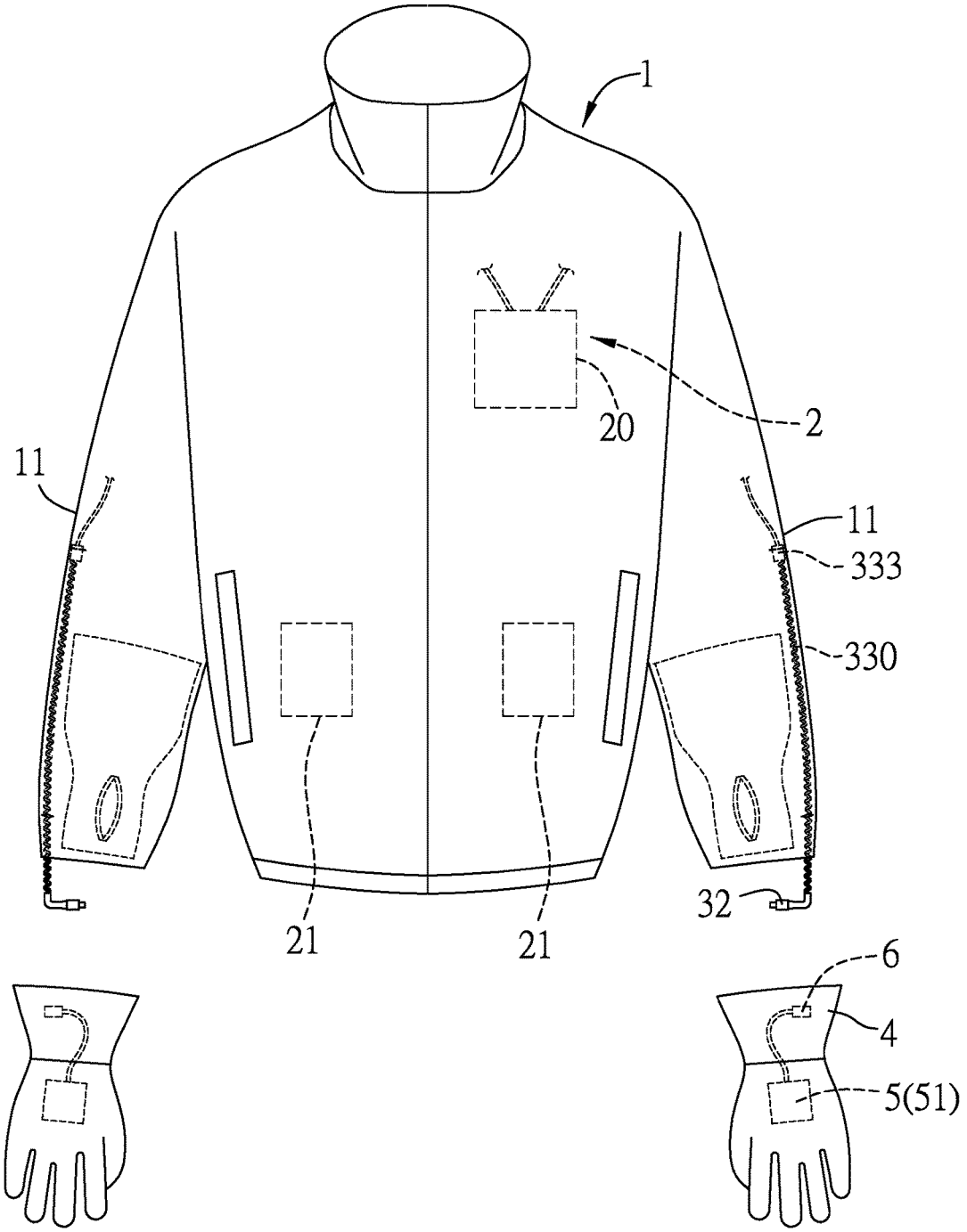
FIG. 5 is a schematic front view illustrating a third embodiment of the electric garment according to the disclosure.
Figure 6:
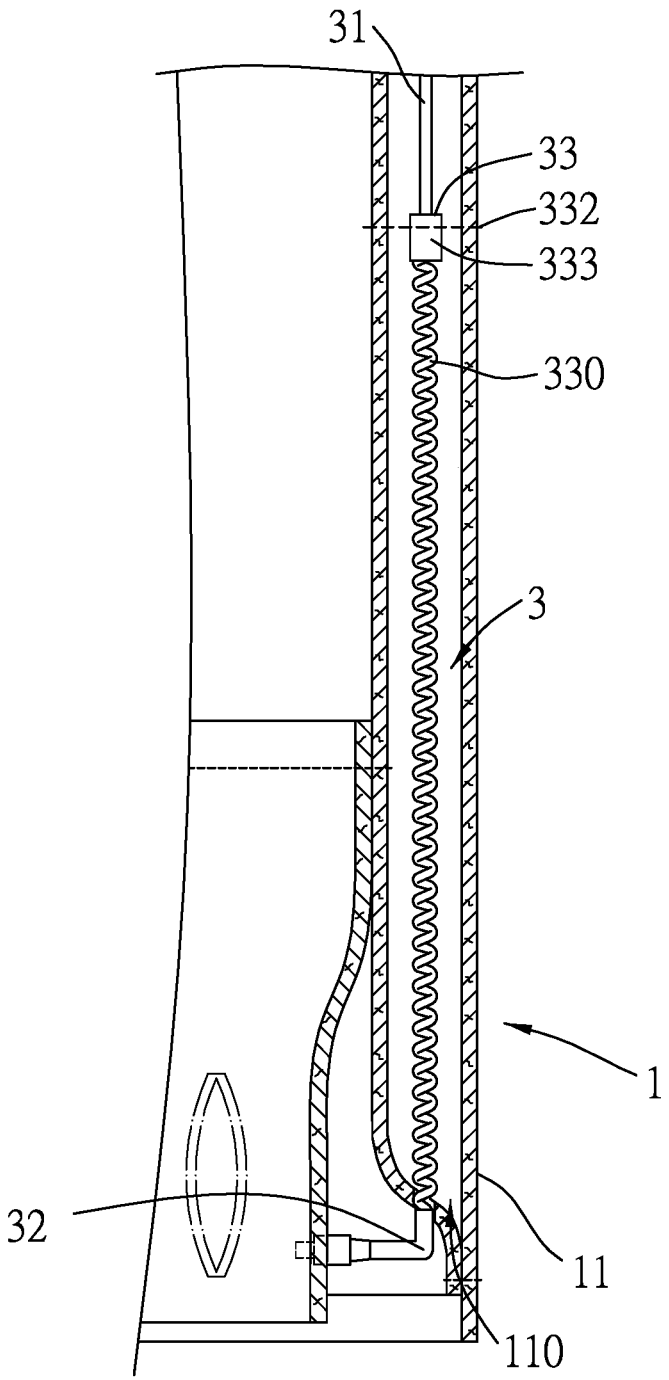
FIG. 6 is an enlarged fragmentary partly sectional view of the third embodiment, illustrating the first connector at the concealed position.

Referring to FIGS. 5 and 6, a third embodiment of the electric garment according to the disclosure is similar to the second embodiment. The difference between the second and third embodiments resides in that the extension cord 34 and the fixing member 331 (see FIG. 2) of each of the retractable connector assemblies 3 are omitted in the third embodiment. The elastic member 330 of each of the retractable connector assemblies 3 of the third embodiment is configured as a helical electric wire that electrically interconnects the corresponding electric cord 31 and the corresponding first connector 32, and serves as the extension cord 34 of the second embodiment. The retractable unit 33 of each of the retractable connector assemblies 3 of the third embodiment further includes a fixing member 333 that cooperates with the stitch line 332 to fix an end of the elastic member 330, which is distal from the first connector 32, to the article of clothing 1. To be more specific, for each retractable connector assembly 3 of the third embodiment, the elastic member 330 and the electric cord 31 are fixedly connected by the fixing member 333. The end of the elastic member 330, which is distal from the first connector 32, is fixed to the article of clothing 1 via the stitch line 332 to join the outer cloth layer 112, the inner lining layer 113, and the fixing member 333 together.

Figure 7:
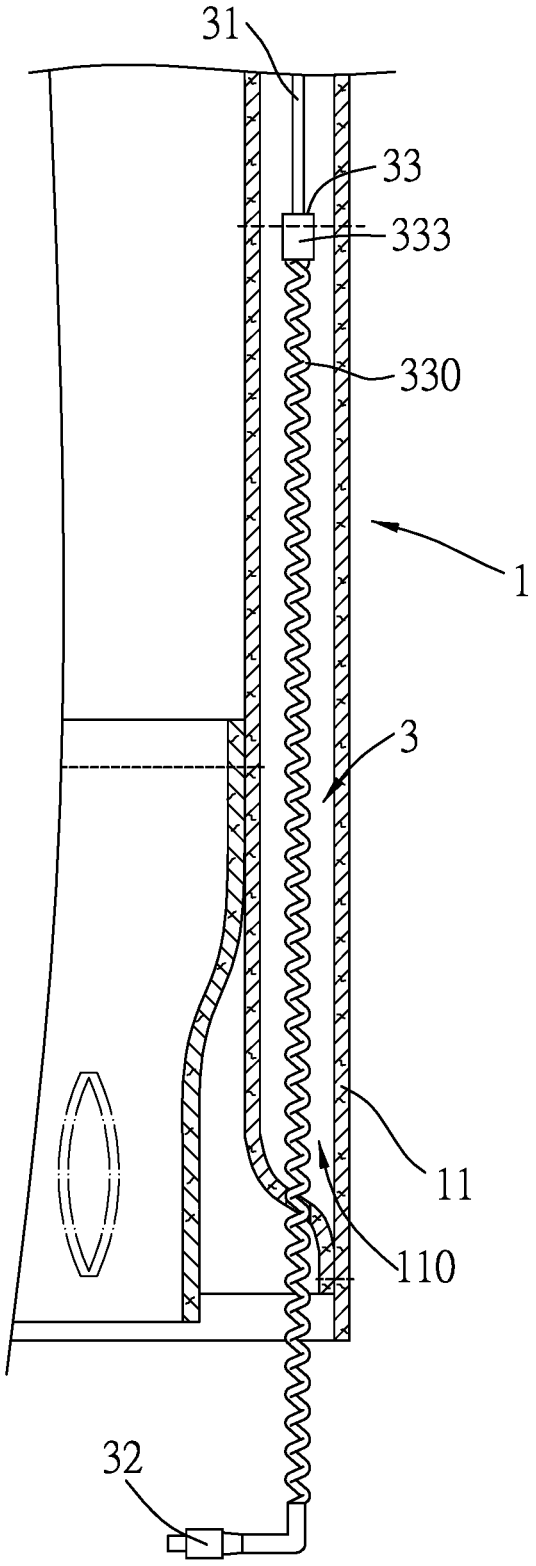
FIG. 7 is a view similar to FIG. 6, but illustrating the first connector of the third embodiment at the exposed position.

Referring to FIGS. 6 and 7, when the first connector 32 is pulled out of the corresponding limb part 11 to the exposed position, the elastic member 330 is stretched and deformed to generate the restoring force.

Figure 8:
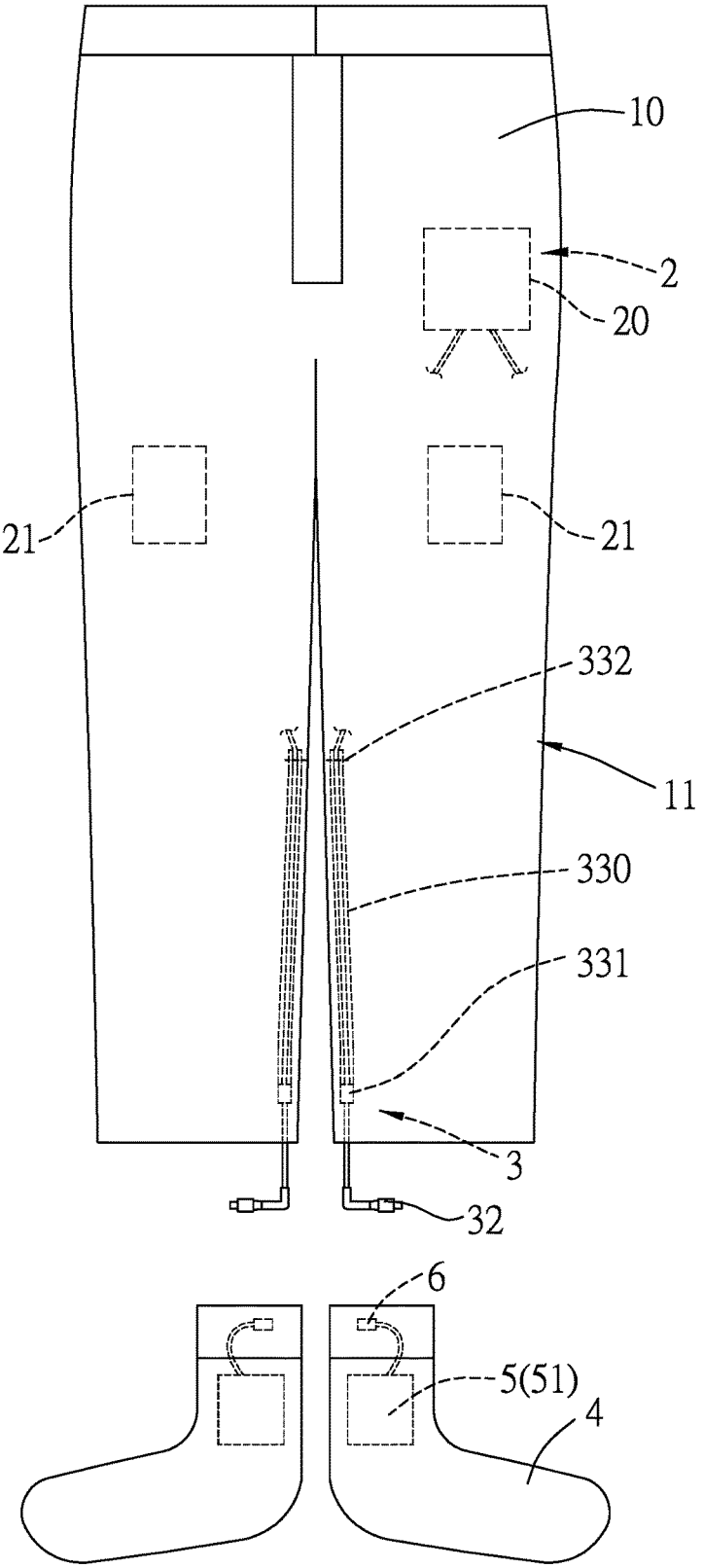
FIG. 8 is a schematic front view illustrating a fourth embodiment of the electric garment according to the disclosure.

Referring to FIG. 8, a fourth embodiment of the electric garment according to the disclosure is similar to the first embodiment. The difference between the first and fourth embodiments resides in that the article of clothing 1 of the fourth embodiment is a pair of pants, each of the limb parts 11 is a pant leg, and the wearable accessories 4 are a pair of socks that can be respectively worn on two feet of the wearer.

To sum up, by virtue of the configuration of the elastic member 330, the first connector 32 of each of the retractable connector assemblies 3 can automatically move back to the concealed position from the exposed position after the first and second connectors 32, 6 are disconnected, thereby minimizing the possibility of cord tangling, and increasing convenience for the wearer. In addition, the glove-resembling portions 12 of the article of clothing 1 permit the first connector 32 of each of the retractable connector assemblies 3 to be easily reached by the wearer.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding various inventive aspects.

While the disclosure has been described in connection with what is considered the exemplary embodiments, it is understood that this disclosure is not limited to the disclosed embodiment but is intended to cover various arrangements included within the spirit and scope of the broadest interpretation so as to encompass all such modifications and equivalent arrangements.

What is claimed is:

1. An electric garment adapted to be worn by a wearer, said electric garment comprising:

an article of clothing including a clothing main body and two limb parts, at least one of said limb parts being formed with a slit;

a first electrical device attached to said article of clothing; and a retractable connector assembly, including:

an electric cord that is electrically connected to said first electrical device, and that is at least partially received in said slit;

a first connector that is electrically connected to said electric cord, wherein the first connector is movable relative to said article of clothing between a concealed position, where said first connector is concealed within said at least one of said limb parts and located outside of said slit, and an exposed position, where said first connector is exposed from said at least one of said limb parts; and a retractable unit that includes an elastic member connected to said electric cord, wherein when said first connector is moved from the concealed position to the exposed position, said elastic member is deformed for generating a restoring force to move said first connector back to the concealed position, wherein the electric cord is configured to allow electricity to be transmitted from the first electrical device to the first connector.

2. The electric garment as claimed in claim 1, wherein said elastic member is configured as an elastic strap.

3. The electric garment as claimed in claim 2, wherein said elastic member has a first end that is proximate to said first connector, and a second end that is distal from said first connector and that is fixedly disposed in said slit.

4. The electric garment as claimed in claim 3, wherein said retractable unit further includes a fixing member that fixes said first end of said elastic member to an end of said electric cord which is proximate to said first connector.

5. The electric garment as claimed in claim 3, wherein said retractable connector assembly further includes an extension cord that electrically interconnects said electric cord and said first connector.

6. The electric garment as claimed in claim 5, wherein said electric cord and said extension cord are integrally formed.

7. The electric garment as claimed in claim 3, wherein each of said limb parts of said article of clothing is a sleeve, said second end of said elastic member being fixed in said slit at a position that corresponds to a shoulder of the wearer.

8. The electric garment as claimed in claim 3, wherein each of said limb parts of said article of clothing is a sleeve, said second end of said elastic member being fixed in said slit at a position that corresponds to an elbow of the wearer.

9. The electric garment as claimed in claim 1, wherein said elastic member of said retractable unit is configured as a helical electric wire that electrically interconnects said electric cord and said first connector.

10. The electric garment as claimed in claim 9, wherein said retractable unit further includes a fixing member that fixes an end of said elastic member, which is distal from said first connector, to said article of clothing.

11. The electric garment as claimed in claim 1, further comprising:

a wearable accessory that is adapted to be worn on one of two hands of the wearer which is adjacent to said slit of said at least one of said limb parts;

a second electrical device that is attached to said wearable accessory; and a second connector that is electrically connected to said second electrical device, and that is operable to be connected to said first connector so as to permit electricity to be transmitted from said first electrical device to said second electrical device.

12. The electric garment as claimed in claim 11, wherein said article of clothing is an upper garment, each of said limb parts of said article of clothing being a sleeve, said wearable accessory being a glove.

13. The electric garment as claimed in claim 12, wherein:

said at least one of said limb parts includes an inner lining layer and an outer cloth layer that surrounds said inner lining layer and that cooperates with said inner lining layer to define said slit therebetween; and said article of clothing further includes a glove-resembling portion that is connected to said inner lining layer, that is disposed at a position corresponding to a cuff of said at least one of said limb parts, and that is formed with a through hole adapted for a thumb of the wearer to extend therethrough.

14. The electric garment as claimed in claim 1, further comprising:

a wearable accessory that is adapted to be worn on one of two feet of the wearer which is adjacent to said slit of said at least one of said limb parts;

a second electrical device that is attached to said wearable accessory; and a second connector that is electrically connected to said second electrical device, and that is operable to be connected to said first connector so as to permit electricity to be transmitted from said first electrical device to said second electrical device.

15. The electric garment as claimed in claim 14, wherein said article of clothing is a pair of pants, each of said limb parts of said article of clothing being a pant leg, said wearable accessory being a sock.

16. The electric garment as claimed in claim 11, wherein:

said first electrical device includes a power supply and at least one electric-heating element that is electrically connected to said power supply; and said second electrical device includes an electric-heating element that is powered by said power supply when said first connector is connected to said second connector at the exposed position.

17. The electric garment as claimed in claim 1, wherein said slit has an exit end adjacent to a cuff of said at least one of said limb parts, said first connector being shaped so as to prevent said first connector from entering into said slit via said exit end.

18. The electric garment as claimed in claim 17, wherein said first connector is L-shaped.

* * * * *